US007814761B2

(12) United States Patent
Uchida

(10) Patent No.: US 7,814,761 B2
(45) Date of Patent: Oct. 19, 2010

(54) AIR CONDITIONER

(75) Inventor: Keisuke Uchida, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 988 days.

(21) Appl. No.: 11/607,860

(22) Filed: Dec. 4, 2006

(65) Prior Publication Data

US 2007/0144200 A1 Jun. 28, 2007

(30) Foreign Application Priority Data

Dec. 5, 2005 (JP) ..... 2005-350402

(51) Int. Cl.
*F25B 13/00* (2006.01)

(52) U.S. Cl. ..... 62/324.4; 62/509

(58) Field of Classification Search ..... 62/324.4, 62/509, 513, 515, 160, 324.1; 165/110, 104.22, 165/153, 174
See application file for complete search history.

(56) References Cited

U.S. PATENT DOCUMENTS 3,537,274 A * 11/1970 Tilney ..... 62/324.1
3,850,592 A * 11/1974 Huffman ..... 95/123
5,172,758 A * 12/1992 Aoki ..... 165/110
5,228,315 A * 7/1993 Nagasaka et al. ..... 62/509
2003/0217567 A1* 11/2003 Oh et al. ..... 62/507

FOREIGN PATENT DOCUMENTS

| | | | |
|---|---|---|---|
| JP | 53-107767 | | 9/1978 |
| JP | 54-1449 | | 1/1979 |
| JP | 61-27458 | A | 2/1986 |
| JP | 4-281170 | A | 10/1992 |
| JP | 5-87426 | A | 4/1993 |
| JP | 10-238895 | A | 9/1998 |
| JP | 2001-116381 | A | 4/2001 |
| JP | 2001-174092 | A | 6/2001 |
| JP | 2006-97992 | A | 4/2006 |

* cited by examiner

*Primary Examiner*—Mohammad M Ali
(74) *Attorney, Agent, or Firm*—Birch, Stewart, Kolasch & Birch LLP

(57) ABSTRACT

An air conditioner according to the present invention prevents freezing of an outdoor heat exchanger in heating operation. A refrigeration cycle is formed by sequentially connecting a compressor 1, a four-way valve 2, an indoor heat exchanger 3, a pressure reducing device 4, and an outdoor heat exchanger 5. In the refrigeration cycle, a high-temperature and high-pressure refrigerant compressed by the compressor 1 flows through a receiver tank 6 before supplied for indoor heating. The receiver tank 6 is placed in the outdoor heat exchanger 5, and thus heat from the receiver tank 6 through which the high-temperature and high-pressure refrigerant flows can be used to prevent freezing of a fin or a tube 10 in the outdoor heat exchanger 5, thereby ensuring heating performance.

3 Claims, 4 Drawing Sheets

AIR CONDITIONER

BACKGROUND OF THE INVENTION

1. Field of the Invention

The present invention relates to an air conditioner, and more particularly to prevention of freezing of a heat exchanger in indoor heating operation.

2. Description of the Related Art

As shown in FIG. 4, a conventional air conditioner includes a refrigeration cycle formed by sequentially connecting a compressor 1, a four-way valve 2, an indoor heat exchanger 3, a capillary tube 4 as a pressure reducing device, and an outdoor heat exchanger 5. In cooling operation, the refrigeration cycle forms a refrigerant circulation cycle in which a refrigerant flows from the compressor 1 through the four-way valve 2 to the outdoor heat exchanger 5, then to the capillary tube 4, and returns from the indoor heat exchanger 3 to the compressor 1. In heating operation, the refrigeration cycle forms a refrigerant circulation cycle in which the refrigerant flows from the compressor 1 through the four-way valve 2 to the indoor heat exchanger 3, then to the capillary tube 4, and returns from the outdoor heat exchanger 5 to the compressor 1.

In the refrigeration cycle, the amount of required refrigerant to be circulated is not always the same between cooling and heating capabilities. In order to eliminate such a difference in the amount of refrigerant, a receiver tank 6 is provided between the four-way valve 2 and the indoor heat exchanger 3 as shown in FIG. 4 (see Japanese Patent Laid-Open No. 2001-174092).

The amount of refrigerant in the receiver tank 6, the capillary tube, the volume of air, or the like are adjusted to prevent freezing of a fin or a tube 10 in the heat exchangers 3 and 5 in the cooling operation or the heating operation.

SUMMARY OF THE INVENTION

However, in the refrigeration cycle, a low-temperature and low pressure refrigerant may flow into the outdoor heat exchanger 5 in the heating operation and into the indoor heat exchanger 3 in the cooling operation, causing the fin or the tube 10 in the indoor and outdoor heat exchangers 3 and 5 to freeze.

Thus, the receiver tank 6 for adjusting the amount of refrigerant, the capillary tube 4 for adjusting pressure reduction, or the volume of air from a fan are adjusted to accommodate freezing of the heat exchangers, but such measures are insufficient to eliminate freezing of the heat exchangers.

Freezing of the heat exchangers reduces heat exchange efficiency thereof to reduce cooling and heating capabilities, and an air conditioner has been therefore desired that can more effectively prevent freezing.

In view of the above, the present invention has an object to provide an air conditioner that can particularly prevent freezing of an outdoor heat exchanger in heating operation of a heat exchanger.

In order to achieve the above described object, the present invention provides an air conditioner including a refrigeration cycle formed by sequentially connecting a compressor, a four-way valve, an indoor heat exchanger, a pressure reducing device, and an outdoor heat exchanger, wherein the air conditioner further includes a receiver tank through which a high-temperature and high-pressure refrigerant flows that is compressed by the compressor and to be supplied for indoor heating, the receiver tank being placed in the outdoor heat exchanger.

According to the above described configuration, heat from the receiver tank through which the high-temperature and high-pressure refrigerant flows can be used to prevent freezing of a fin or a tube in the outdoor heat exchanger, thereby ensuring heating performance.

The receiver tank may be placed in any connecting position in the refrigeration cycle as long as the high-temperature and high-pressure refrigerant can flow therethrough. For example, the receiver tank may be connected between the four-way valve and the indoor heat exchanger.

According to the above described configuration, the high-temperature and high-pressure refrigerant compressed by the compressor flows into the receiver tank before supplied for indoor heating. Thus, the high-temperature and high-pressure refrigerant flows through the receiver tank, and the receiver tank is heated by the high-temperature refrigerant. The heat can be used to prevent freezing of the fin or the tube in the outdoor heat exchanger.

In the refrigeration cycle, a bypass having an on-off valve is provided between a discharge side of the compressor and a connection between the pressure reducing device and the outdoor heat exchanger so that part of the bypass passes through the receiver tank.

According to the above described configuration, if the on-off valve is opened in the heating operation, the high-temperature and high-pressure refrigerant flows from the compressor through the bypass, and part of the bypass passes through the receiver tank. Thus, the receiver tank is heated, and the heat can be used to prevent freezing of the outdoor heat exchanger.

The receiver tank is preferably placed near an outlet tube or a tube that is apt to freeze in the outdoor heat exchanger in the heating operation. One receiver tank or two or more receiver tanks may be mounted. Further, the heat from the receiver tank may be used in such a manner that the receiver tank is brought into contact with the fin or the tube to cause heat transfer, or in a manner using radiant heat in a noncontact state to prevent freezing of the heat exchanger.

The prevention of freezing with the receiver tank is used when the amount of circulated refrigerant in the heating operation is smaller than in the cooling operation. Thus, the receiver tank mounted to the heat exchanger has no influence on refrigeration circulation or cooling performance in the cooling operation.

As described above, according to the present invention, the receiver tank is provided through which the high-temperature and high-pressure refrigerant flows that is compressed by the compressor and to be supplied for indoor heating, the receiver tank being placed in the outdoor heat exchanger, and thus the heat from the receiver tank through which the high-temperature and high-pressure refrigerant flows can be used to prevent freezing of the fin or the tube in the outdoor heat exchanger, thereby ensuring heating performance.

DETAILED DESCRIPTION OF THE PREFERRED EMBODIMENTS

Figure 1:
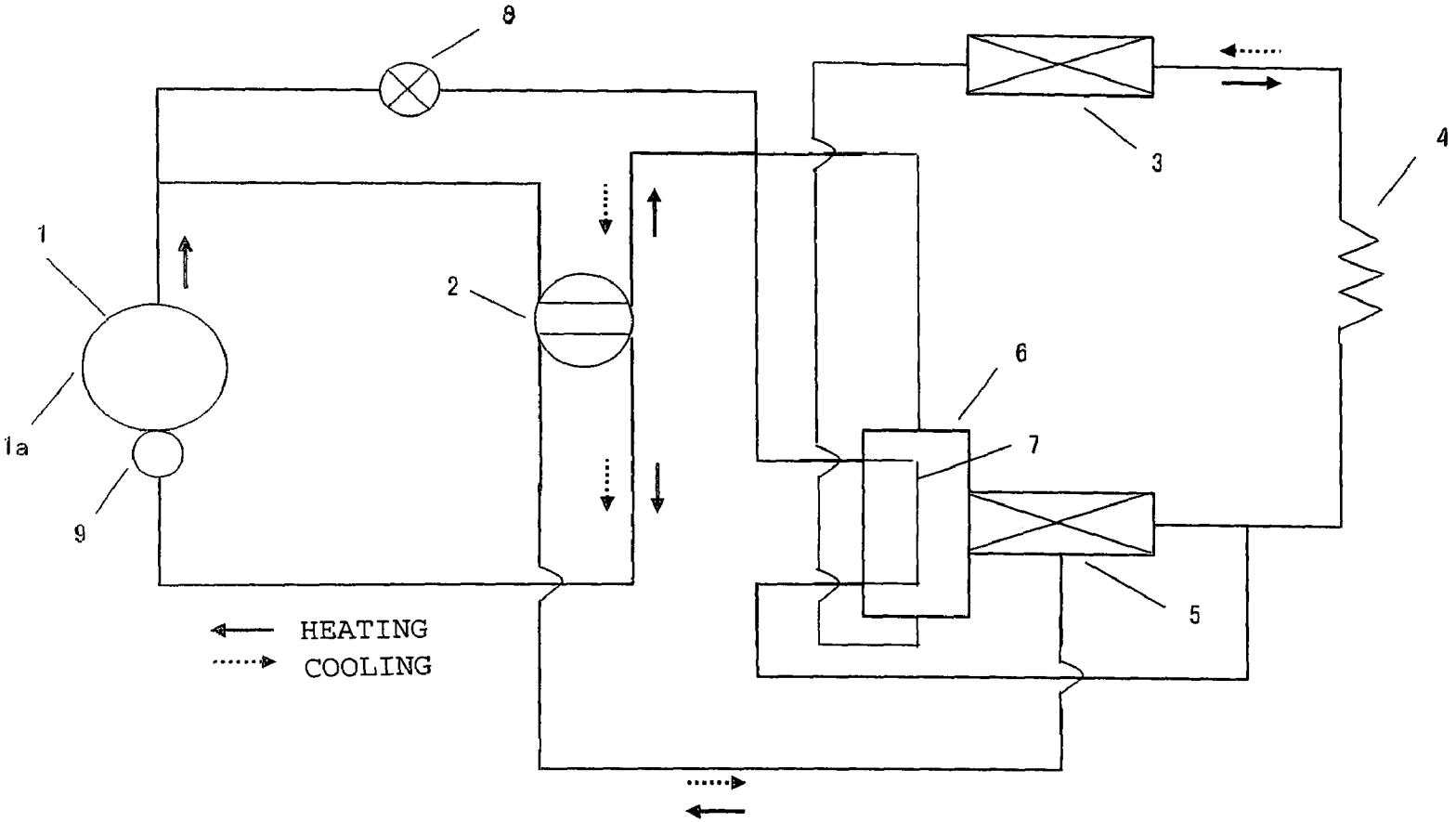
FIG. 1 shows a refrigeration cycle of an air conditioner according to an embodiment of the present invention.

Now, an air conditioner according to an embodiment of the present invention will be described with reference to the drawings. The air conditioner of the embodiment includes part of a closed-loop refrigeration cycle that is formed by sequentially connecting a compressor 1, a four-way valve 2, an indoor heat exchanger 3, a capillary tube 4, and an outdoor heat exchanger 5, and repeats compression with the compressor 1, condensation with a condenser, pressure reduction with a capillary tube 4, and evaporation with an evaporator to circulate a refrigerant.

The condenser corresponds to the outdoor heat exchanger 5 in cooling operation, and to the indoor heat exchanger 3 in heating operation. The evaporator corresponds to the indoor heat exchanger 3 in the cooling operation, and to the outdoor heat exchanger 5 in the heating operation.

A receiver tank 6 is provided between the four-way valve 2 and the indoor heat exchanger 3, and a bypass 7 is provided via an on-off valve 8 between a discharge side 1*a* of the compressor 1 and a connection between the capillary tube 4 and the outdoor heat exchanger 5, and part of the bypass 7 passes through the receiver tank 6.

For example, in the heating operation, a high-temperature and high-pressure refrigerant discharged from the compressor 1 is supplied through the four-way valve 2 to the indoor heat exchanger 3, and condensed in the indoor heat exchanger 3 to release heat. Then, the refrigerant is reduced in pressure in the capillary tube 4, passed through a tube 10 in the outdoor heat exchanger 5 to be evaporated, passed through the four-way valve 2 and the accumulator 9, and returned to the compressor 1. In the cooling operation, the refrigerant is circulated in reverse order to the heating operation, and thus the detailed description thereof will be omitted.

Figure 4:
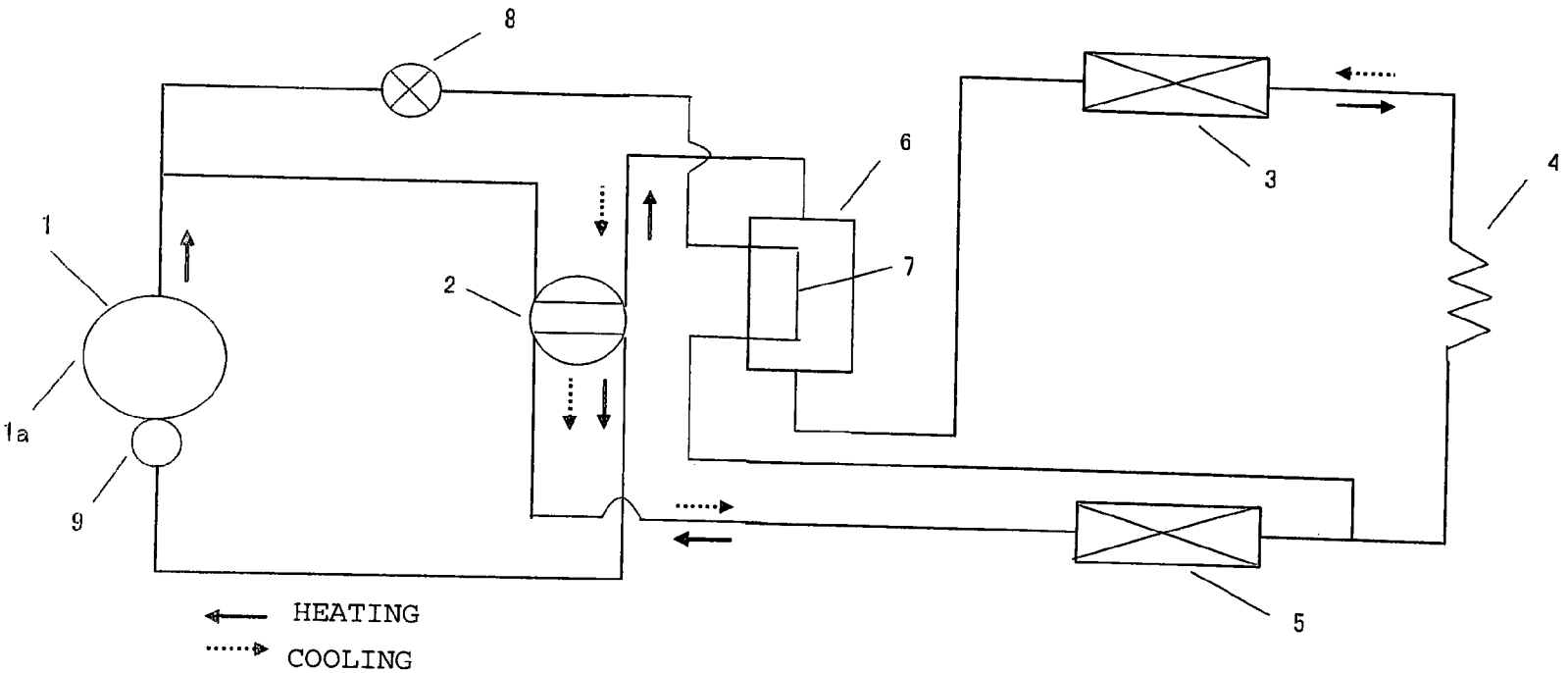
FIG. 4 shows a refrigerant cycle of a conventional air conditioner.

FIG. 1 shows a configuration of a refrigeration cycle when the receiver tank 6 is placed near the outdoor heat exchanger 5. The circulation of the refrigerant is the same as in FIG. 4, and the description thereof will be omitted.

Figure 2:
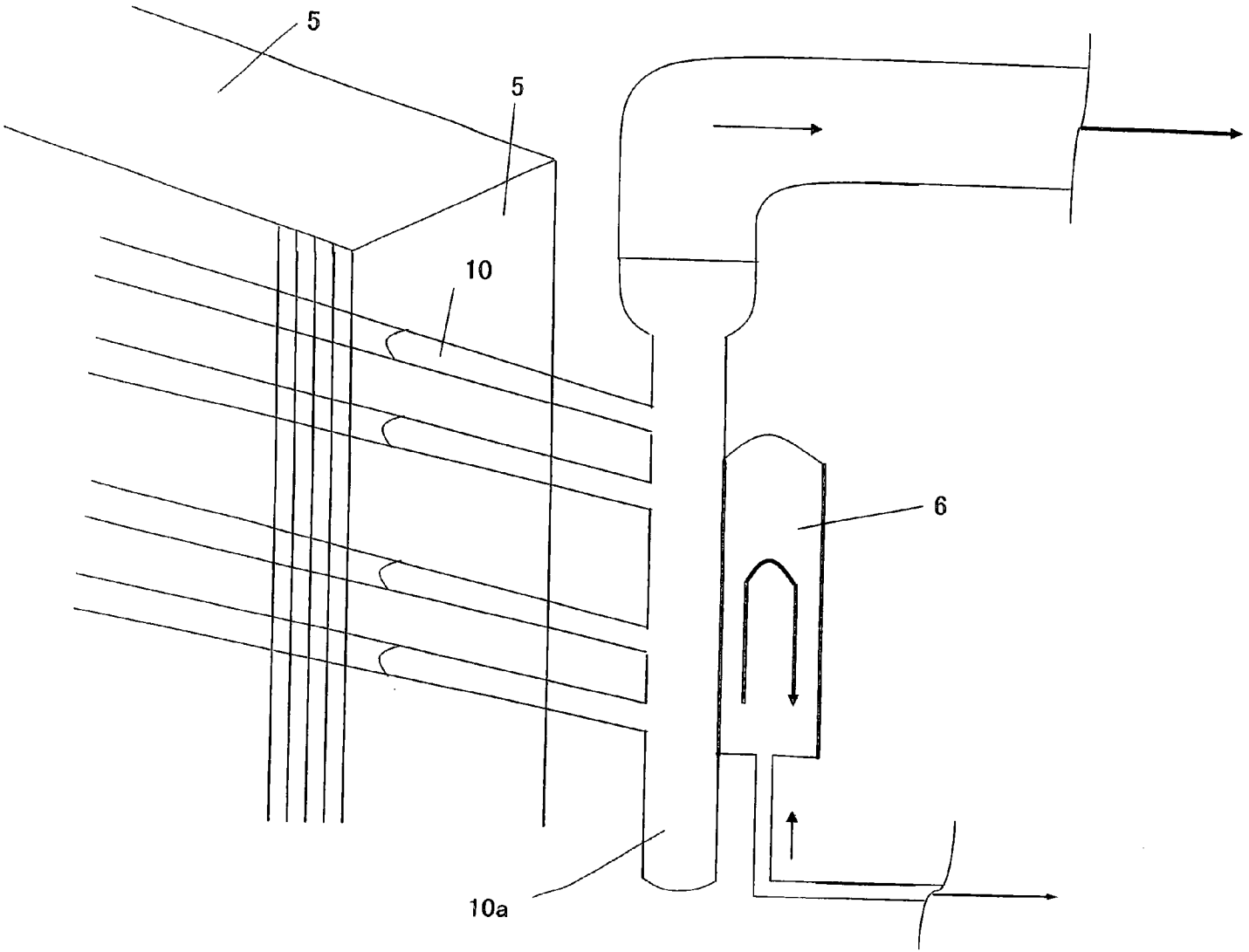
FIG. 2 is an enlarged view when a receiver tank and an outdoor heat exchanger are connected.

FIG. 2 is an enlarged view when the receiver tank 6 and the outdoor heat exchanger 5 in FIG. 1 are connected. The receiver tank 6 that allows by itself part of the high-temperature and high-pressure refrigerant that is compressed by the compressor 1 and to be supplied for indoor heating to flow into the outdoor heat exchanger 5 is mounted near an outlet tube 10*a* (in heating) of the outdoor heat exchanger 5.

Figure 3:
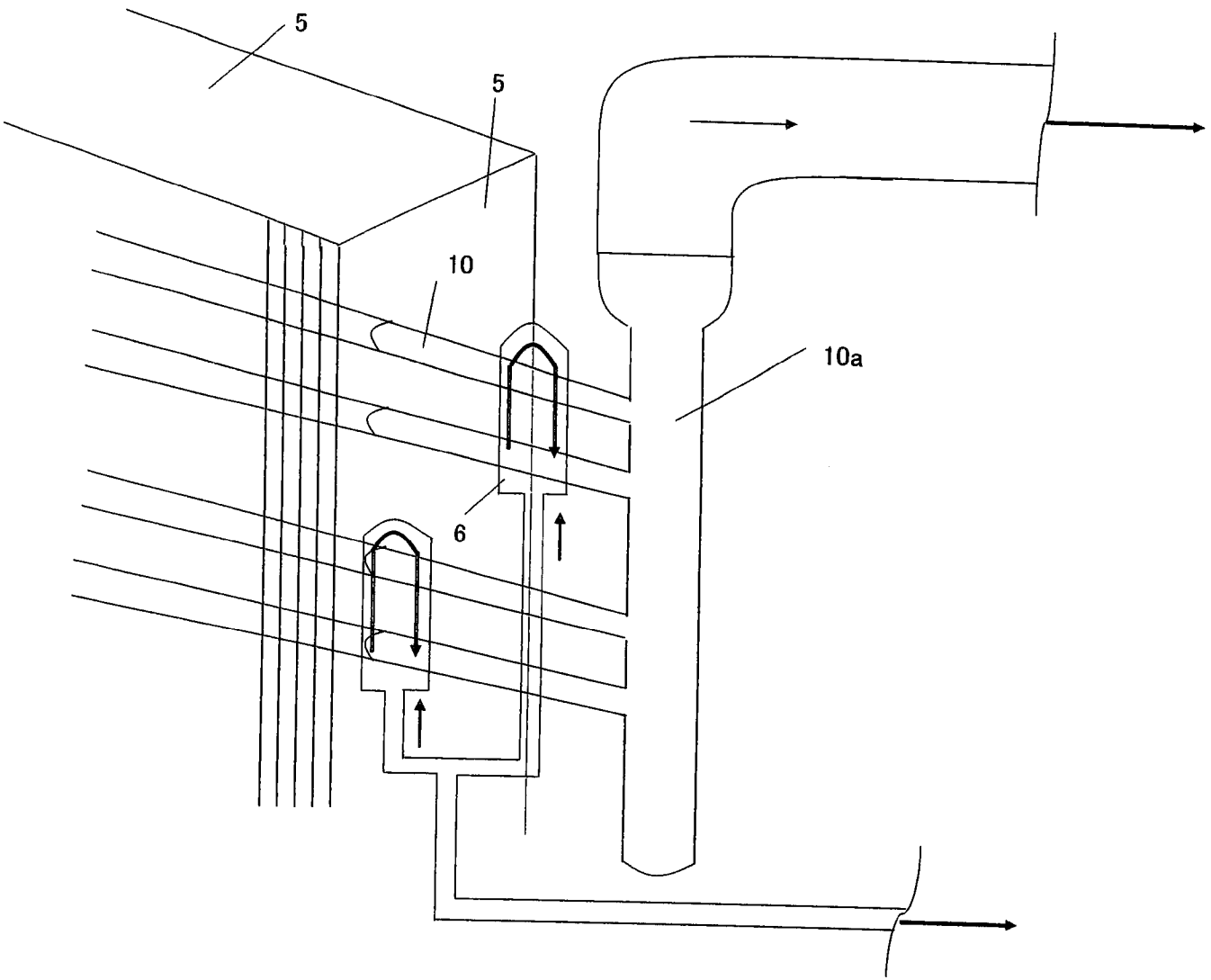
FIG. 3 is a perspective view of an example in which receiver tanks are mounted near tubes that are apt to freeze in the outdoor heat exchanger.

FIG. 3 shows an example in which two or more receiver tanks 6 are mounted near tubes that are apt to freeze in the outdoor heat exchanger 5.

The heat from the receiver tank 6 may be used in such a manner that the receiver tank 6 is brought into contact with a fin or a tube in the heat exchanger to cause heat transfer, or in a manner using radiant heat in a noncontact state to prevent freezing of the heat exchanger.

According to the above described configuration, the heat from the receiver tank 6 through which the high-temperature and high-pressure refrigerant flows is used to prevent freezing of the fin or the tube 10 in the heat exchanger 5, thereby ensuring heating performance without reducing heat exchange efficiency of the heat exchanger 5.

The present invention is not limited to the above described embodiment, and various modifications or changes may be, of course, made within the scope of the present invention.

What is claimed is:

1. An air conditioner comprising a refrigeration cycle formed by sequentially connecting a compressor, a four-way valve, an indoor heat exchanger, a pressure reducing device, and an outdoor heat exchanger, wherein said air conditioner further comprises a plurality of receiver tanks through which a high-temperature and high-pressure refrigerant flows that is compressed by the compressor and to be supplied for indoor heating, said outdoor heat exchanger being provided with a plurality of fins and tubes, and wherein said plurality of receiver tanks are placed either near an outlet tube of the outdoor heat exchanger in the heating operation or in contact with the plurality of fins or tubes of the outdoor heat exchanger in the heating operation.

2. The air conditioner according to claim 1, wherein said receiver tanks are connected between the four-way valve and the indoor heat exchanger in said refrigeration cycle.

3. The air conditioner according to claim 2, wherein in said refrigeration cycle, a bypass having an on-off valve is provided between a discharge side of the compressor and a connection between said pressure reducing device and the outdoor heat exchanger so that part of said bypass passes through said receiver tanks.

* * * * *